US009080402B2

(12) United States Patent
Connor et al.

(10) Patent No.: US 9,080,402 B2
(45) Date of Patent: Jul. 14, 2015

(54) METHOD AND APPARATUS FOR REMOVING UNEXPANDED SHOE

(71) Applicant: ENVENTURE GLOBAL TECHNOLOGY, LLC, Houston, TX (US)

(72) Inventors: Eric James Connor, Katy, TX (US); Harsh V. Chowdhary, Houston, TX (US); Frederick C. Bennett, Houston, TX (US); Nanda K. Boddeda, Houston, TX (US); Ronald T. Robinson, Katy, TX (US)

(73) Assignee: ENVENTURE GLOBAL TECHNOLOGY, INC., Houston, TX (US)

( * ) Notice: Subject to any disclaimer, the term of this patent is extended or adjusted under 35 U.S.C. 154(b) by 0 days.

(21) Appl. No.: 14/196,003

(22) Filed: Mar. 4, 2014

(65) Prior Publication Data

US 2014/0251617 A1 Sep. 11, 2014

Related U.S. Application Data

(60) Provisional application No. 61/773,705, filed on Mar. 6, 2013.

(51) Int. Cl.

| | |
|---|---|
| ***E21B 29/00*** | (2006.01) |
| ***E21B 17/14*** | (2006.01) |
| ***E21B 23/00*** | (2006.01) |
| ***E21B 31/16*** | (2006.01) |
| ***E21B 43/10*** | (2006.01) |

(52) U.S. Cl.

CPC ..... *E21B 29/005* (2013.01); *E21B 17/14* (2013.01); *E21B 23/00* (2013.01); *E21B 29/00* (2013.01); *E21B 31/16* (2013.01); *E21B 43/103* (2013.01)

(58) Field of Classification Search

CPC ..... E21B 29/00; E21B 17/14; E21B 23/00; E21B 31/12; E21B 29/005; E21B 31/16; E21B 43/103

See application file for complete search history.

(56) References Cited

U.S. PATENT DOCUMENTS

| | | | | |
|---|---|---|---|---|
| 4,887,668 | A | 12/1989 | Lynde et al. | |
| 8,047,278 | B2 | 11/2011 | Swietlik et al. | |
| 8,146,682 | B2 | 4/2012 | Rhinehart et al. | |
| 2002/0033261 | A1 * | 3/2002 | Metcalfe | 166/285 |
| 2003/0121655 | A1 * | 7/2003 | Lauritzen et al. | 166/207 |
| 2004/0251027 | A1 | 12/2004 | Sonnier et al. | |
| 2007/0007011 | A1 | 1/2007 | Carmody et al. | |
| 2010/0032169 | A1 * | 2/2010 | Adam et al. | 166/382 |

OTHER PUBLICATIONS

Search Report and Written Opinion dated Jun. 16, 2014 for corresponding International Application No. PCT/US2014/020107 (11 pgs.).

* cited by examiner

*Primary Examiner* — Brad Harcourt
*Assistant Examiner* — Wei Wang
(74) *Attorney, Agent, or Firm* — Derek V. Forinash; Porter Hedges LLP

(57) ABSTRACT

A method of removing an unexpanded shoe comprises disposing a tool in a wellbore. The tool includes a latch assembly and a mill body. The latch assembly is engaged with a shoe assembly that is coupled to the wellbore by a tubular having an expanded portion and an unexpanded portion. The mill body is rotated relative to the latch assembly so as to mill the unexpanded portion of the tubular until the shoe assembly is uncoupled from the wellbore. The tool and the shoe assembly are then pulled through the expanded portion and out of the wellbore.

14 Claims, 6 Drawing Sheets

METHOD AND APPARATUS FOR REMOVING UNEXPANDED SHOE

CROSS-REFERENCE TO RELATED APPLICATIONS

This application claims the benefit under 35 U.S.C. §119 (e) of U.S. Provisional Patent Application No. 61/773,705 filed Mar. 6, 2013, the disclosure of which is hereby incorporated herein by reference.

BACKGROUND

This disclosure relates generally to methods and apparatus for drilling a wellbore. More specifically, this disclosure relates to methods and apparatus for removing an unexpanded shoe, or other restriction, from a cased wellbore.

In the oil and gas industry, expandable tubing is often used for casing, liners and the like. To create a casing, for example, a tubular member is installed in a wellbore and subsequently expanded by displacing an expansion cone through the tubular member. The expansion cone may be pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial force, the tubular member plastically deforms, thereby permanently increasing both its inner and outer diameters. In other words, the tubular member expands radially.

Expandable tubulars often include a shoe assembly coupled to the lower end of the tubular that enables cementing operations to be performed through the expandable tubular. Once the expandable tubular is installed, the shoe assembly has to be removed to allow drilling to continue. This is often accomplished by milling or drilling out the shoe assembly. The shoe assembly may be constructed from composite materials, cast iron, or other materials that simplify the removal of the shoe assembly.

In certain expandable tubular applications, a portion of the expandable tubular adjacent to the shoe assembly is left unexpanded while the tubular above that portion is expanded. The unexpanded tubular creates a diametrical constriction that must also be removed before drilling ahead. Removing both the unexpanded tubular material and the shoe assembly has conventionally involved multiple trips into the wellbore for milling and fishing or the utilization of complex tools that may be prone to malfunction.

Thus, there is a continuing need in the art for methods and apparatus for removing a shoe assembly and unexpanded tubular from an expanded tubular member.

BRIEF SUMMARY OF THE DISCLOSURE

A method of removing an unexpanded shoe comprises disposing a tool in a wellbore. The tool includes a latch assembly and a mill body. The latch assembly is engaged with a shoe assembly that is coupled to the wellbore by a tubular having an expanded portion and an unexpanded portion. The mill body is rotated relative to the latch assembly so as to mill the unexpanded portion of the tubular until the shoe assembly is uncoupled from the wellbore. The tool and the shoe assembly are then pulled through the expanded portion and out of the wellbore.

BRIEF DESCRIPTION OF THE DRAWINGS

For a more detailed description of the embodiments of the present disclosure, reference will now be made to the accompanying drawings, wherein.

DETAILED DESCRIPTION

Figures 1A, 1B, 1C:
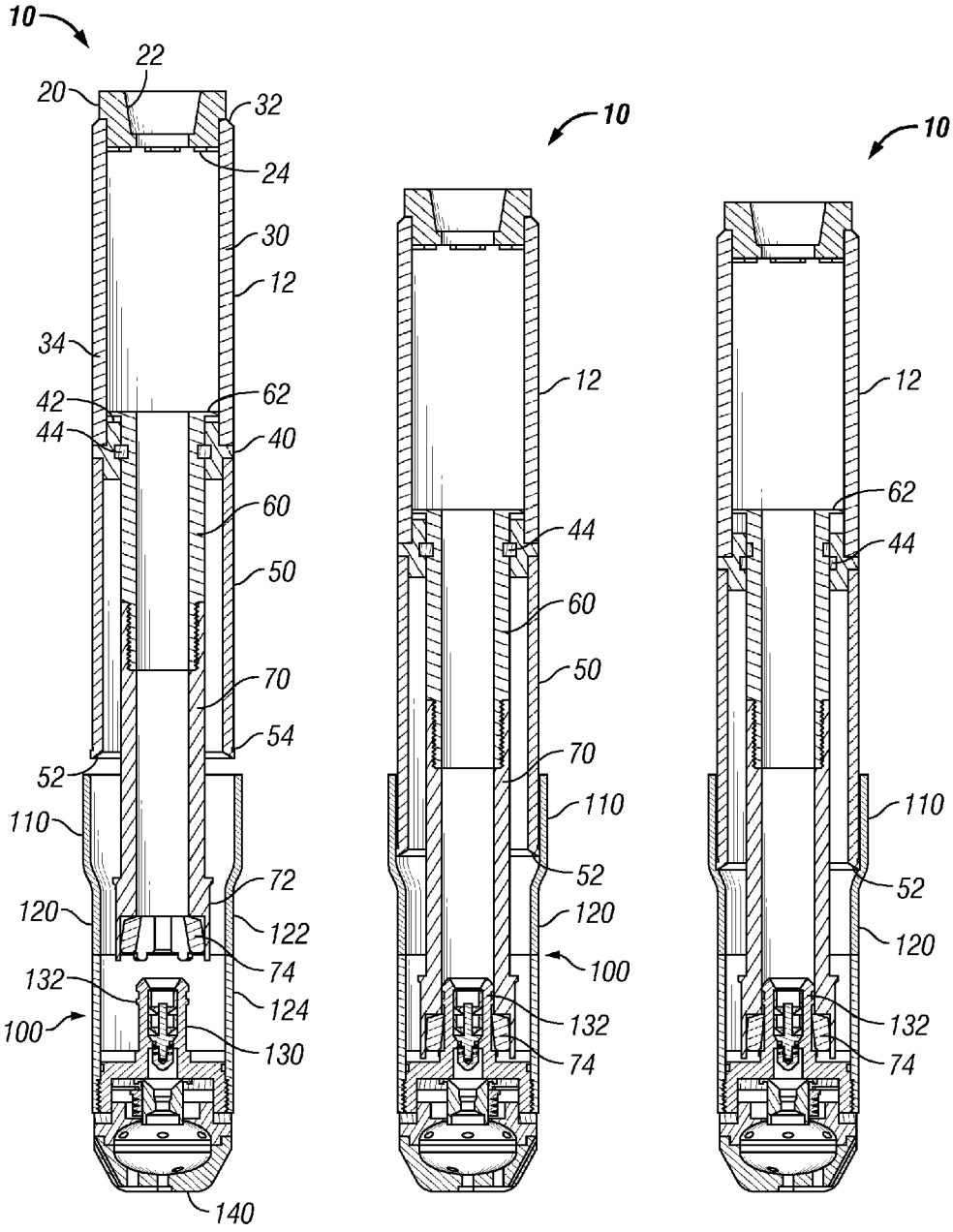
FIGS. 1A-1E are sequence drawings illustrating the removal of an unexpanded shoe from a non-cemented expanded tubular.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIGS. 1A-1E, a tool 10 comprises an upper sub 20, an upper body 30, a mandrel guide 40, a mill body 50, a latch mandrel 60, and a latch assembly 70. Upper sub 20 includes a threaded connection 22 that allows the tool 10 to be coupled to a drill pipe or other tubular. The upper sub 20 is coupled to top 32 of the upper body 30. The bottom 34 of the upper body 30 is coupled to mandrel guide 40. Mill body 50 is coupled to and extends from mandrel guide 40 and includes a hardened milling face 52 at its lower end 54. When assembled, the upper sub 20, upper body 30, mandrel guide 40, and mill body 50 form a unitary tool body 12 such that entire tool body 12 rotates when the upper sub 20 is rotated by a drill pipe (not shown).

The latch mandrel 60 and latch assembly 70 are coupled together and disposed within the tool body 12. The lower end 72 of the latch assembly 70 is illustrated as including an internal fishing latch 74, but it is understood that in other embodiments, other fishing or latching mechanisms can be used in place of the illustrated internal fishing latch 74. For example, latch assembly 70 may include an external fishing latch, a spear, a grapple, J-slot, or any other desired type of fishing or latching mechanism.

The latch mandrel 60 includes a notched flange 62 that is configured to engage upper sub slots 24 or mandrel guide slots 42 when the notched flange 62 contacts either the upper sub 20 or the mandrel guide 40. The engagement of the notched flange 62 with either the upper sub slots 24 or the mandrel guide slots 42 cause the latch mandrel 60 and latch assembly 70 to rotate with the tool body 12. When the notched flange 62 is not engaged with either the upper sub slots 24 or the mandrel guide slots 42, the latch mandrel 60 and latch assembly 70 are free to rotate independently of the tool body 12.

When in the running position, as shown in FIG. 1A, the latch mandrel 60 is frangibly attached to the mandrel guide 40 by releasable connection 44, which may be shear pins, a shear ring, or some other frangible connection. Once the releasable connection 44 releases, the latch mandrel 60 and latch assembly 70 are free to translate relative to the tool body 12.

In FIGS. 1A-1E, tool 10 is shown in operation milling and removing a portion of an expanded tubular 100 including an expanded portion 110, an unexpanded portion 120, a shoe assembly 130, and a nose 140. The expanded portion 110 is anchored in a wellbore (not shown) and extends a distance upward through the wellbore. The shoe assembly 130 and nose 140 are coupled to the unexpanded portion 120. Shoe assembly 130 includes a fishing neck 132 or other structure that is designed to be engaged be the latch assembly 70. In certain embodiments, the latch assembly 70 and shoe assembly 130 may also include features that allow the latch assembly 70 to rotationally lock to the shoe assembly 130. Nose 140 may be constructed from a relatively low strength material that can be easily milled or drilled.

Referring now to FIG. 1A, the tool 10 is run into a wellbore containing an expanded tubular 100. As the tool 10 reaches the bottom of the expanded tubular 100, fishing latch 74 is aligned with fishing neck 132. As the tool 10 is lowered, the fishing latch 74 will engage the fishing neck 132, as shown in FIG. 1B. Once the fishing latch 74 has fully engaged the fishing neck 132, as shown in FIG. 1C, continued lowering of the tool 10 will release the releasable connection 44 and allow the tool body 12 to rotate as it is translated downward relative to the latch mandrel 60 and latch assembly 70.

Figure 1D:
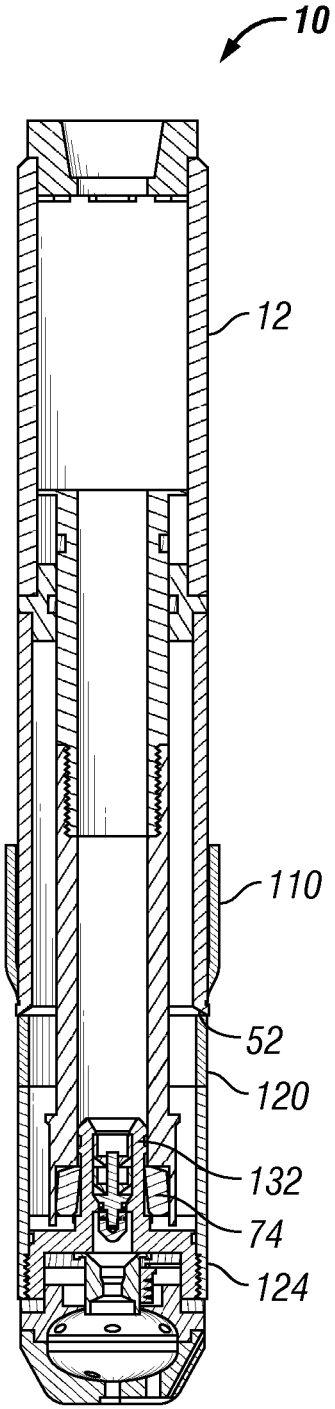
Figure 1E:
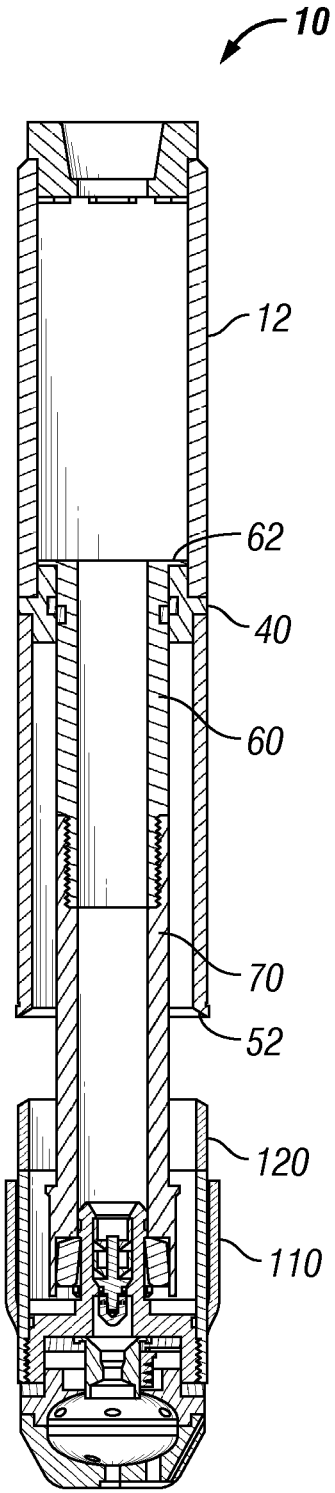

As the tool 10 is being lowered and rotated, the milling face 52 of the mill body 50 contacts the unexpanded portion 120 and mills, or cuts, the unexpanded tubular as shown in FIG. 1D. The lowering and rotation of the tool 10 is continued until the unexpanded portion 120 is detached from the expanded portion 110. Once the unexpanded portion 120 is detached, the tool 10, which is coupled to the shoe assembly 130 via latch assembly 70, is pulled from the wellbore. As the tool 10 is pulled, the unexpanded portion 120, shoe assembly 130, and nose 140 pass through the expanded portion 110 and are retrieved with the tool 10, as is shown in FIG. 1E.

Referring now to FIGS. 2A-2E, tool 10 is shown in operation milling and removing a portion of an expanded tubular 200 including an expanded portion 210, an unexpanded portion 220, a shoe assembly 230, and a nose 240. The expanded portion 210 is cemented in a wellbore (not shown) and extends a distance upward through the wellbore. The shoe assembly 230 and nose 240 are coupled to the unexpanded portion 220. Shoe assembly 230 includes a fishing neck 232 or other structure that is designed to be engaged be the latch assembly 70. Nose 240 may be constructed from a relatively low strength material that can be easily milled or drilled.

Figures 2A, 2B, 2C:
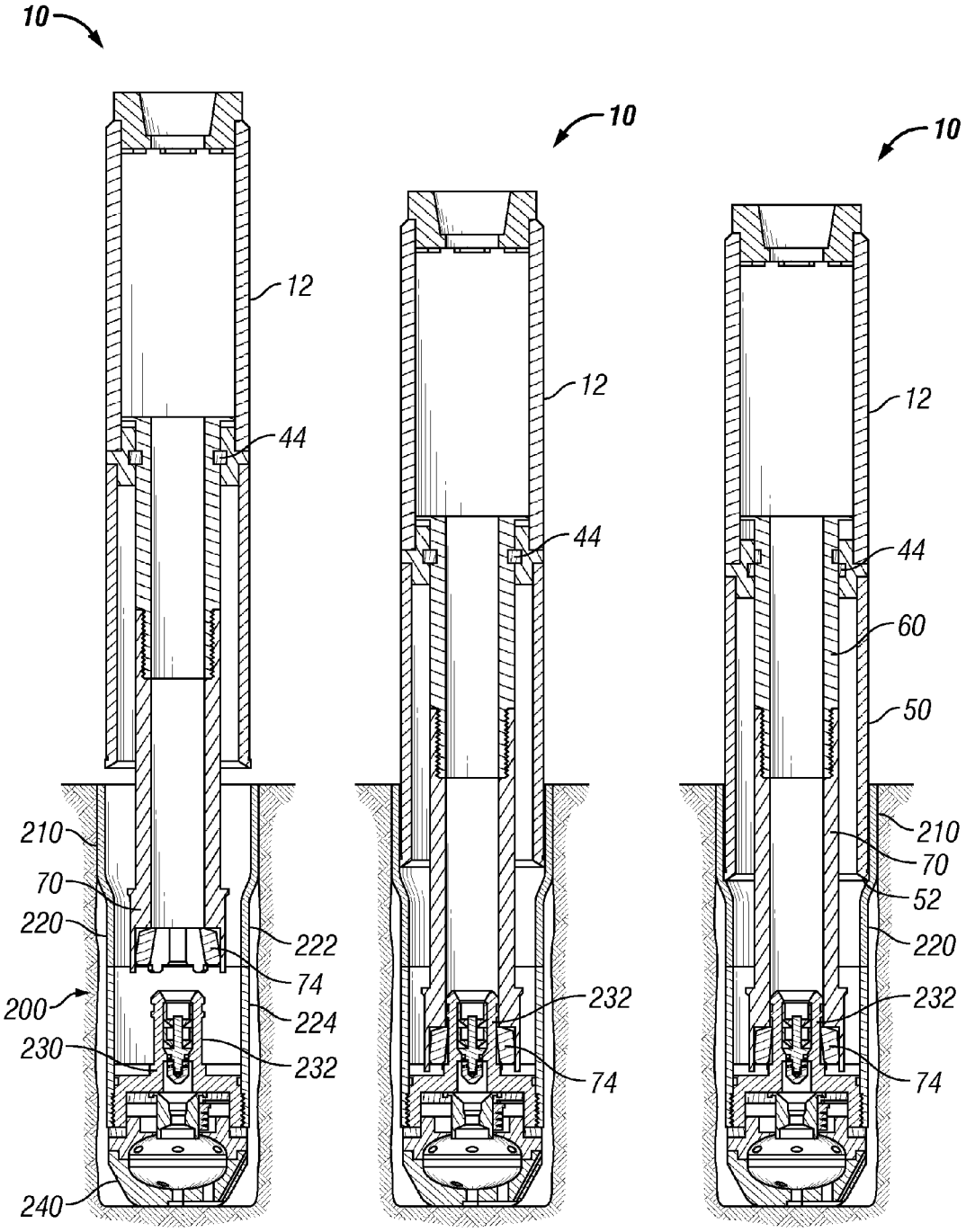
FIGS. 2A-2E are sequence drawings illustrating the removal of an unexpanded shoe from a cemented expanded tubular.

Referring now to FIG. 2A, the tool 10 is run into a wellbore containing an expanded tubular 200. As the tool 10 reaches the bottom of the expanded tubular 200, fishing latch 74 is aligned with fishing neck 232. As the tool 10 is lowered, the fishing latch 74 will engage the fishing neck 232, as shown in FIG. 2B. Once the fishing latch 74 has fully engaged the fishing neck 232, as shown in FIG. 2C, continued lowering of the tool 10 will release the releasable connection 44 and allow the tool body 12 to move downward relative to the latch mandrel 60 and latch assembly 70.

Figure 2D:
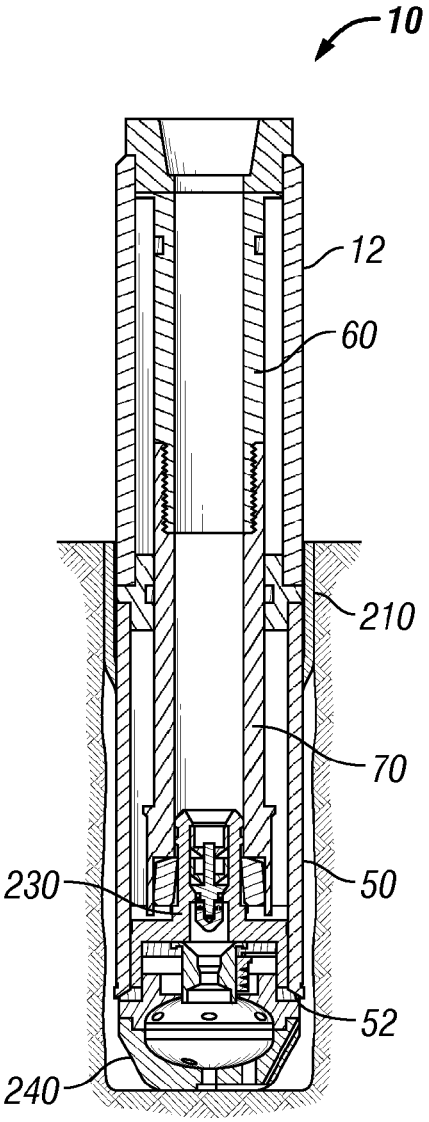
Figure 2E:
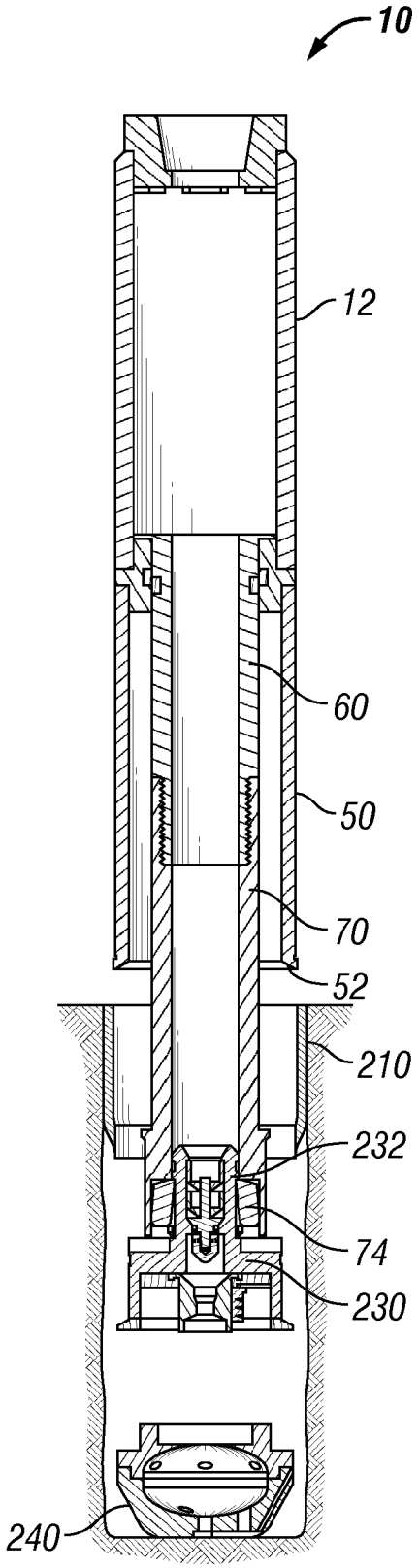

While the tool 10 is being lowered it is also being rotated such that as the milling face 52 of the mill body 50 contacts the unexpanded portion 220 it will cut the tubular as shown in FIG. 2D. The lowering and rotation of the tool 10 is continued until the unexpanded portion 220 is completely milled or until unexpanded portion 220 detaches from the wellbore. As shown in FIG. 2E, the unexpanded portion 220 may be completely removed such that the tool 10 continues cutting until the nose assembly 240 detaches from the shoe assembly 230. Once the shoe assembly 230 is detached, the tool 10, which is coupled to the shoe assembly 230 via latch assembly 70, is pulled from the wellbore. As the tool 10 is pulled the shoe assembly 130 passes through the expanded portion 210 and is retrieved with the tool 10, as is shown in FIG. 2E.

Figure 3:
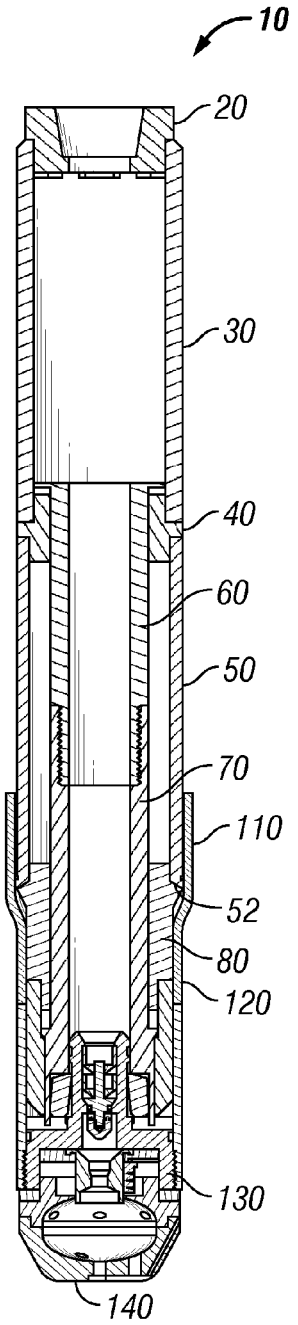
FIG. 3 is a partial sectional view of one embodiment of a tool used in the removal of an unexpanded shoe from an expanded tubular.

Referring now to FIG. 3, an alternate embodiment of a tool 10 is shown including a protective sleeve 80. The protective sleeve 80 may be constructed from an easily millable material, such as aluminum, composite, or plastic. The protective sleeve 80 is disposed adjacent to and extending below the milling face 52 around the latch assembly 70. While the tool 10 is being run into a wellbore, the protective sleeve 80 prevents the leading edge of the milling face 52 from contacting the inner surface of the wellbore to help reduce the possibility of the tool 10 being damaged during running. A portion of the protective sleeve 80 is cut by the milling face 52 as the tool 10 cuts through the unexpanded portion 120.

Figure 4A:
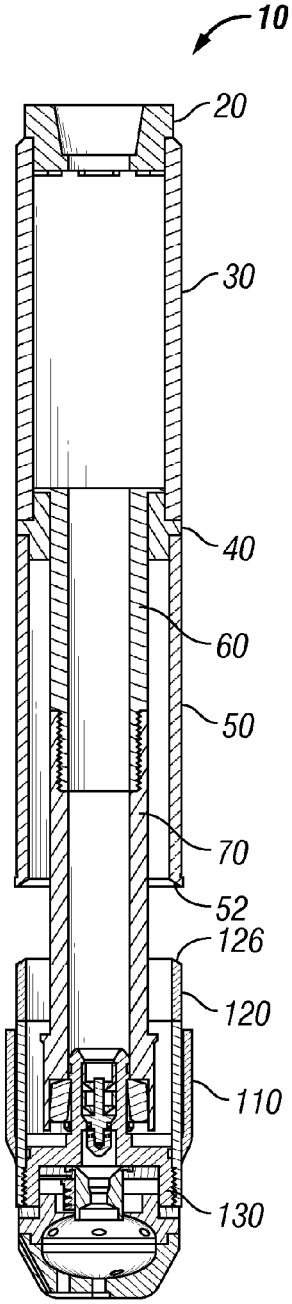
FIGS. 4A and 4B are partial sectional views that illustrate the use of protective sleeve with a tool for the removal of an unexpanded shoe from an expanded tubular.
Figure 4B:
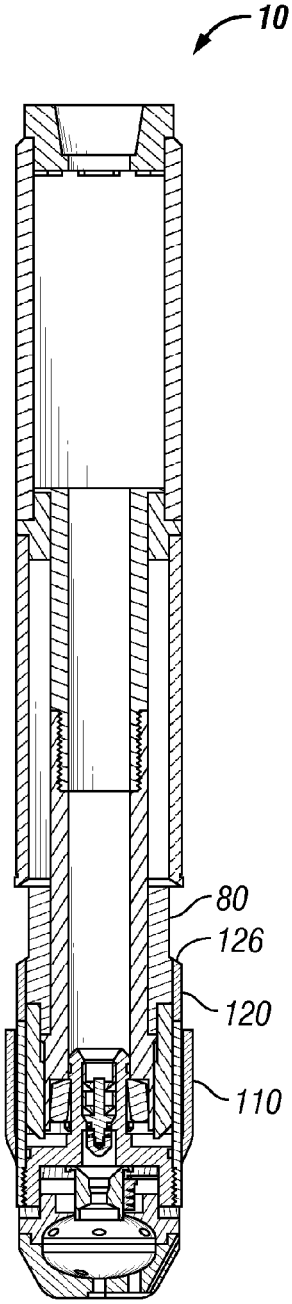

Another benefit of the protective sleeve 80 can be seen with reference to FIGS. 4A and 4B. A tool 10 without a protective sleeve is shown in FIG. 4A being retrieved from a wellbore connected to an unexpanded portion 120. The unexpanded portion 120 has an upper edge 126 that may potentially catch on ledges or other obstructions as the tool 10 is being pulled from the wellbore. In comparison, FIG. 4B shows a tool 10 with a protective sleeve 80 that fills substantially the entire gap between the upper edge 126 of the unexpanded portion 120 and the latch assembly 70. Thus, the protective sleeve 80 reduces the likelihood of the upper edge 126 catching a ledge or other obstruction as the tool 10 is pulled from the wellbore.

Figure 5C:
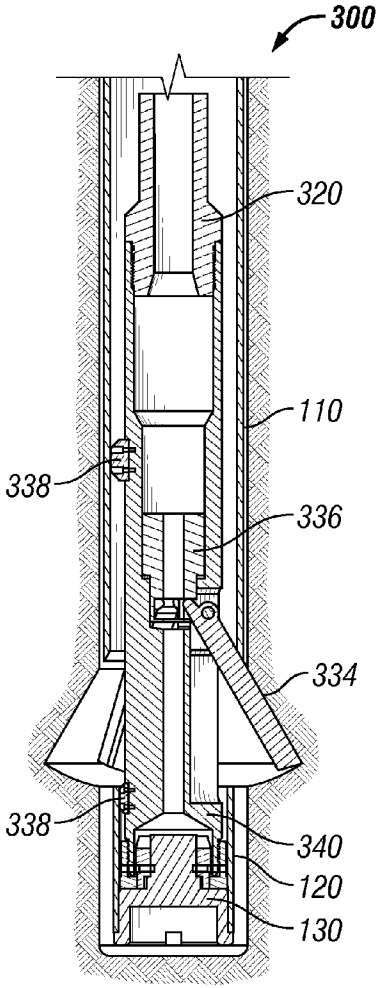
FIGS. 5A-5C are sequence drawings illustrating the removal of an unexpanded shoe.
Figure 5B:
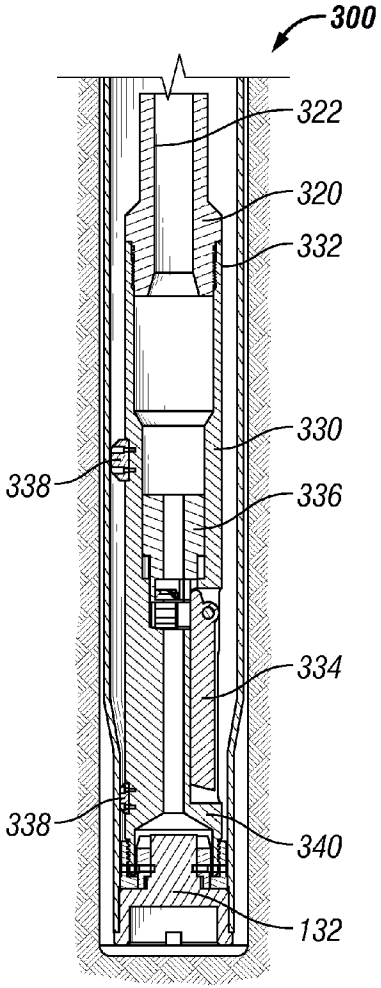
Figure 5A:
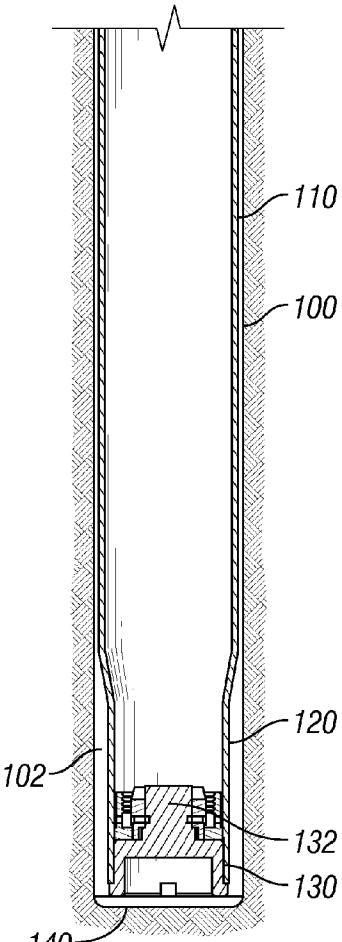

Referring now to FIGS. 5A-5C, tool 300 is shown in operation milling and removing a portion of an expandable tubular 100 including an expanded portion 110, an unexpanded portion 120, a shoe assembly 130, and a nose 140. The expanded portion 110 is anchored in a wellbore 102 and extends a distance upward through the wellbore. The shoe assembly 130 and nose 140 are coupled to the unexpanded portion 120. Shoe assembly 130 includes a fishing neck 132 or other structure that is designed to be engaged be the tool 300.

Tool 300 includes an upper sub 320, a mill body 330, and a latch assembly 340. Upper sub 320 includes a threaded connection 322 that allows the tool 300 to be coupled to a drill pipe or other tubular. The upper sub 320 is coupled to top 332 of the mill body 330. The mill body 330 includes one or more cutting blades 334 and a spring-loaded piston 336. The cutting blades 334 are pivotally coupled to the mill body 330 and are rotated outward as pressure is applied to the spring-loaded piston 336. As the cutting blades 334 are rotated outward, the mill body 330 is rotated so that the cutting blades 334 cut through the expanded portion 110 of the expandable tubular 100 and into the surrounding formation. Tool 300 may also include guide pads 338 that help center the tool 300 within the expandable tubular 100.

Referring now to FIGS. 5B and 5C, the tool 300 is run into the expandable tubular 100, which has an expanded portion 110 and an unexpanded portion 120. As the tool 300 reaches the bottom of the expandable tubular 100, latch assembly 340 is aligned with and engages fishing neck 132. Once the latch assembly 340 has fully engaged the fishing neck 132, hydraulic pressure is applied to the spring-loaded piston 336 and the tool 300 is rotated so that the cutting blades 334 extend outward and cut through the expandable tubular 100. Once the expandable tubular 100 is cut, as shown in FIG. 5C, the hydraulic pressure is reduced so that the cutting blades 334 retract and the tool 300, shoe assembly 130, and unexpanded portion 120 of the expandable tubular 100 can be pulled from the wellbore.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A method of removing an unexpanded shoe comprising:

disposing a tool in a wellbore, wherein the tool includes a latch assembly and a mill body;

engaging a shoe assembly with the latch assembly, wherein the shoe assembly is coupled to the wellbore by a tubular having an expanded portion and an unexpanded portion;

translating and rotating the mill body relative to the latch assembly so as to mill the unexpanded portion of the tubular until the shoe assembly is uncoupled from the wellbore; and pulling the tool and the shoe assembly through the expanded portion and out of the wellbore.

2. The method of claim 1, wherein the entire unexpanded portion of the tubular is milled before the shoe assembly is uncoupled from the wellbore.

3. The method of claim 1, wherein only a portion of the unexpanded portion of the tubular is milled before the shoe assembly is uncoupled from the wellbore.

4. The method of claim 3, wherein the unexpanded portion of the tubular that is not milled is pulled through the expanded portion of the tubular with the shoe assembly.

5. The method of claim 1, wherein the shoe assembly comprises a nose that is detached from the shoe assembly and left in the wellbore.

6. The method of claim 1, wherein the tool includes a protective sleeve disposed between the latch assembly and the mill body.

7. The method of claim 1, wherein the tool includes a releasable connection that couples the latch assembly to the mill body.

8. The method of claim 7, wherein the releasable connection is released after the latch assembly engages the shoe assembly.

9. A method comprising:

coupling a shoe assembly to a lower end of an expandable tubular;

disposing the expandable tubular and the shoe assembly in a wellbore;

expanding the expandable tubular, wherein after expansion of the expandable tubular an unexpanded portion of the expandable tubular is proximate to the shoe assembly and an expanded portion of the expandable tubular extends into the wellbore;

disposing a tool within the expandable tubular, wherein the tool includes a latch assembly disposed within a mill body;

engaging the shoe assembly with the latch assembly;

translating and rotating the mill body relative to the latch assembly so as to mill the unexpanded portion of the expandable tubular until the shoe assembly is uncoupled from the wellbore; and pulling the tool and the shoe assembly through the expandable tubular and out of the wellbore.

10. The method of claim 9, wherein the entire unexpanded portion of the expandable tubular is milled before the shoe assembly is uncoupled from the wellbore.

11. The method of claim 9, wherein only a portion of the unexpanded portion of the expandable tubular is milled before the shoe assembly is uncoupled from the wellbore.

12. The method of claim 11, wherein the unexpanded portion of the expandable tubular that is not milled is pulled through the expanded portion of the tubular with the shoe assembly.

13. The method of claim 9, wherein the shoe assembly comprises a nose that is detached from the shoe assembly and left in the wellbore.

14. The method of claim 9, wherein the tool includes a protective sleeve disposed between the latch assembly and the mill body.

* * * * *